US006931908B1

(12) United States Patent
Mitson

(10) Patent No.: US 6,931,908 B1
(45) Date of Patent: Aug. 23, 2005

(54) TUBE-BENDING DEVICE

(76) Inventor: Ken J. Mitson, 40W381 Winchester Way, St. Charles, IL (US) 60175

( * ) Notice: Subject to any disclaimer, the term of this patent is extended or adjusted under 35 U.S.C. 154(b) by 0 days.

(21) Appl. No.: 11/036,441

(22) Filed: Jan. 13, 2005

(51) Int. Cl.[7] ..... B21D 7/08; B21D 9/08

(52) U.S. Cl. ..... 72/390.2; 72/213; 72/458; 72/477

(58) Field of Search ..... 72/390.2, 390.4, 72/390.5, 389.9, 409, 458, 477, 481, 213

(56) References Cited

U.S. PATENT DOCUMENTS

| | | | | |
|---|---|---|---|---|
| 1,079,442 | A | 11/1913 | Rutledge | |
| 3,464,254 | A | 9/1969 | LeBreton | |
| 3,822,578 | A | 7/1974 | LeBreton | |
| 4,077,249 | A * | 3/1978 | Schmitter | 72/390.2 |
| 4,989,441 | A * | 2/1991 | Wagner | 72/390.2 |

* cited by examiner

*Primary Examiner*—David B. Jones
(74) *Attorney, Agent, or Firm*—Lloyd L. Zickert

(57) ABSTRACT

A tube-bending device including a frame having a reciprocably mounted anvil and a coacting crossbar with tube-restraining blocks, together with a ratchet mechanism for driving the anvil toward the blocks to perform tube-bending operations, wherein the crossbar is reinforced with reinforcing ribs to prevent failure.

14 Claims, 4 Drawing Sheets

TUBE-BENDING DEVICE

This invention relates in general to a tube-bending device for bending tubes, and more particularly to a tube-bending device having a strengthened crossbar to eliminate failure of the crossbar during tube-bending operations.

BACKGROUND OF THE INVENTION

Heretofore, it has been well known to provide tube-bending devices for bending of tube or pipe at a jobsite during construction of facilities using tubes or pipes, such as in plumbing or electrical work.

A tube-bending device similar to the present invention is disclosed in U.S. Pat. No. 4,989,441, which includes an anvil driven by a ratchet mechanism and a crossbar coacting with the anvil for restraining tube or pipe elements during a tube-bending operation. A tube-bending device like that shown in the patent has been commercially produced and marketed for many years.

It has been found that a tube-bending device like the patent experiences crossbar failure which results in the inability of the device to be used and requires return of the device to the manufacturer for repairs and/or replacement. This results in down time to provide tube-bending operations at a worksite.

SUMMARY OF THE INVENTION

The present invention overcomes the problem heretofore known by the tube-bending device above described in reinforcing the crossbar to prevent failure and returns of the device to the manufacturer. It has been found that the crossbar may be reinforced by displacing metal along the crossbar to form reinforcing dimples or ribs and to avoid the problem of failure. Accordingly, the present invention is in a tube-bending device having a reinforced crossbar to provide better performance and overcome crossbar failure.

It is therefore an object of the present invention to provide an improved portable tube-bending device having a crossbar that is reinforced to essentially eliminate failure of the crossbar during tube-bending operations.

Another object of the present invention is to provide an improved tube-bending device with a reinforced crossbar that is produced by defining ribs or dimples in the crossbar.

A further object of the present invention is to provide an improved tube-bending device with a reinforced crossbar that is produced by displacing metal along the crossbar, thereby reinforcing the crossbar to prevent crossbar failure.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
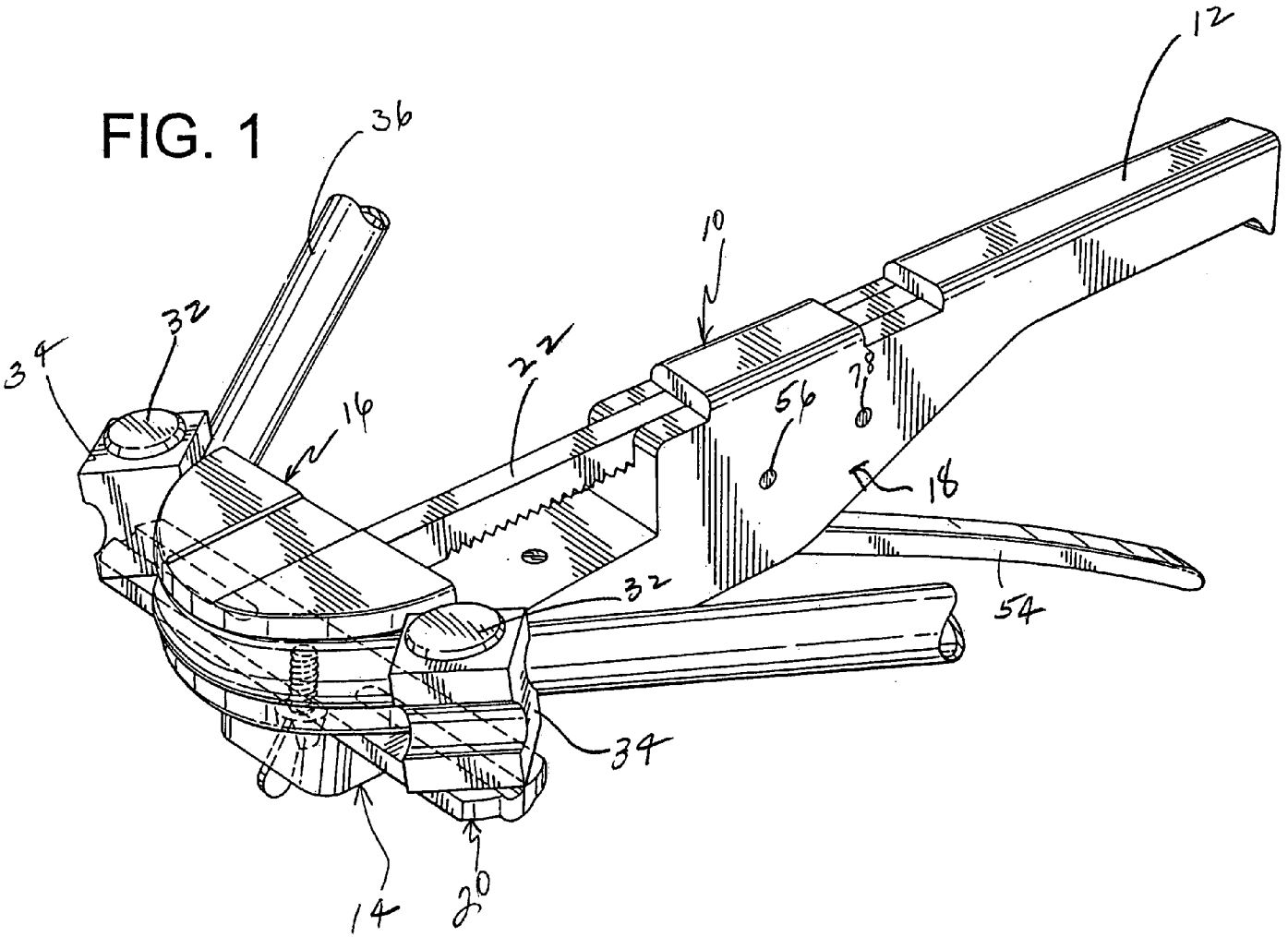
FIG. 1 is a perspective view of the tube-bending device according to the present invention and illustrating a tube-bending operation by the anvil being moved between blocks on the crossbar with the ratchet mechanism.

The tube-bending device of the invention is portable to be used by a person and is capable of bending metal tubes of copper, aluminum, or other metals. It serves to bend tubes of various diameters and can easily be moved from one worksite to another to accomplish the bending process.

Referring now to the drawings, the tube-bending device includes generally a frame 10 having a handle 12 at one end and a tube-bending section 14 at the other end. An anvil 16 against which a tube may be placed is driven by a ratchet mechanism 18. Coacting with the anvil is a crossbar 20 mounted at the tube-bending section or end of the frame. As will be further described below, the crossbar is reinforced to enhance the life and operability of the tube-bending device according to the invention.

Figure 3:
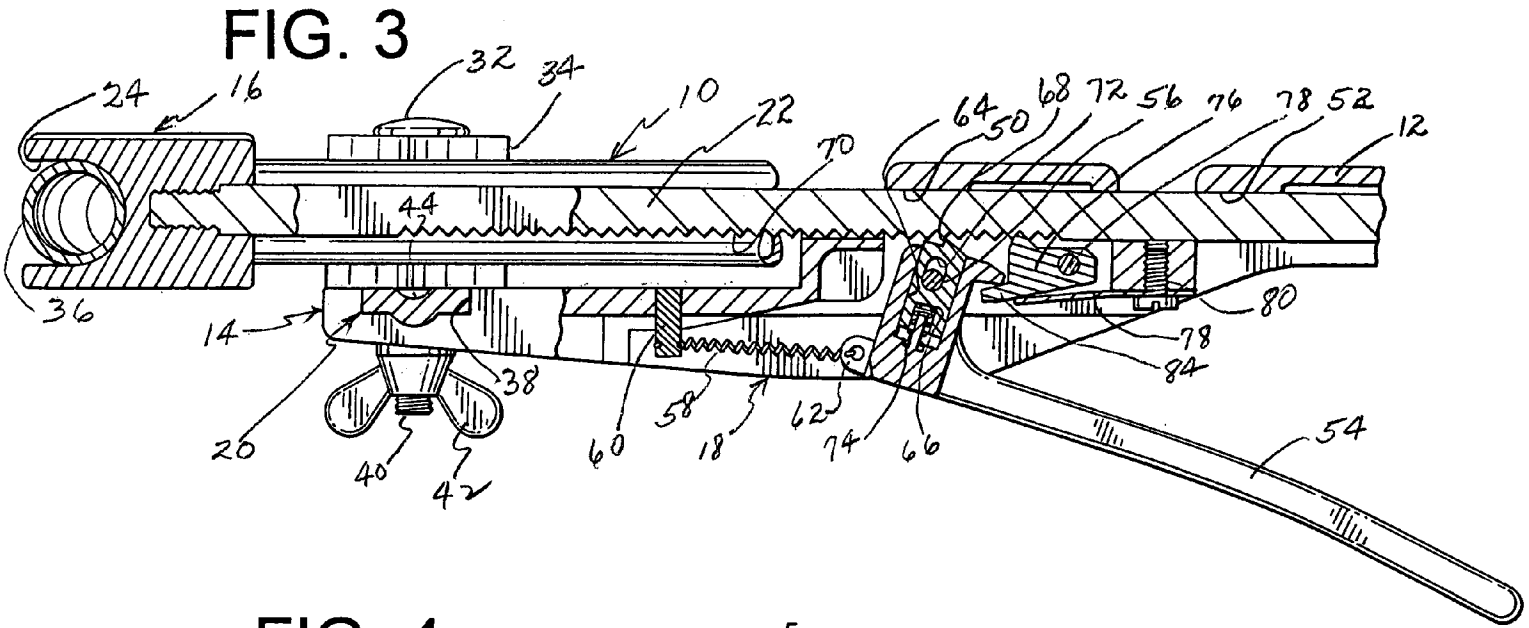
FIG. 3 is a longitudinal sectional view taken through the tube-bending device of FIG. 2 and generally along the line 3—3.

The anvil 16 is mounted on one end of a ratchet bar 22 of the ratchet mechanism 18, and the ratchet bar is reciprocably mounted in bar guides of the frame. The forward end of the ratchet bar 22 may be fixed to the anvil 16 in any suitable manner. As shown in FIG. 3, a threaded stub is provided on the end of the ratchet bar to engage in a threaded bore of the anvil. It will be appreciated that the various parts of the tube-bending device according to the invention are made of metal, such as steel or die-cast metal, although it will be appreciated that it may be made of any other suitable metal that will comply with the strength requirements of the device.

The anvil 16 is in the shape of a semi-circular member having a generally semi-circular tube receiving groove 24 engaging a tube during the tube-bending operation. It will be appreciated that the size of the groove 24 may be such as to accommodate tubes of various diameters, and it should also be appreciated that different anvils may be mounted on the ratchet bar 22 if desired for various tube sizes.

Figure 4:
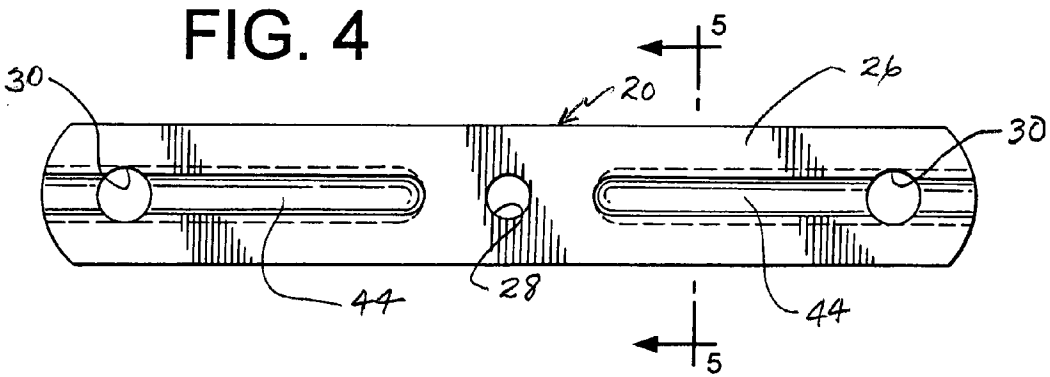
FIG. 4 is a plan view of the crossbar with the tube-retaining blocks removed for purposes of clearly showing the reinforcing ribs.
Figures 5, 6:
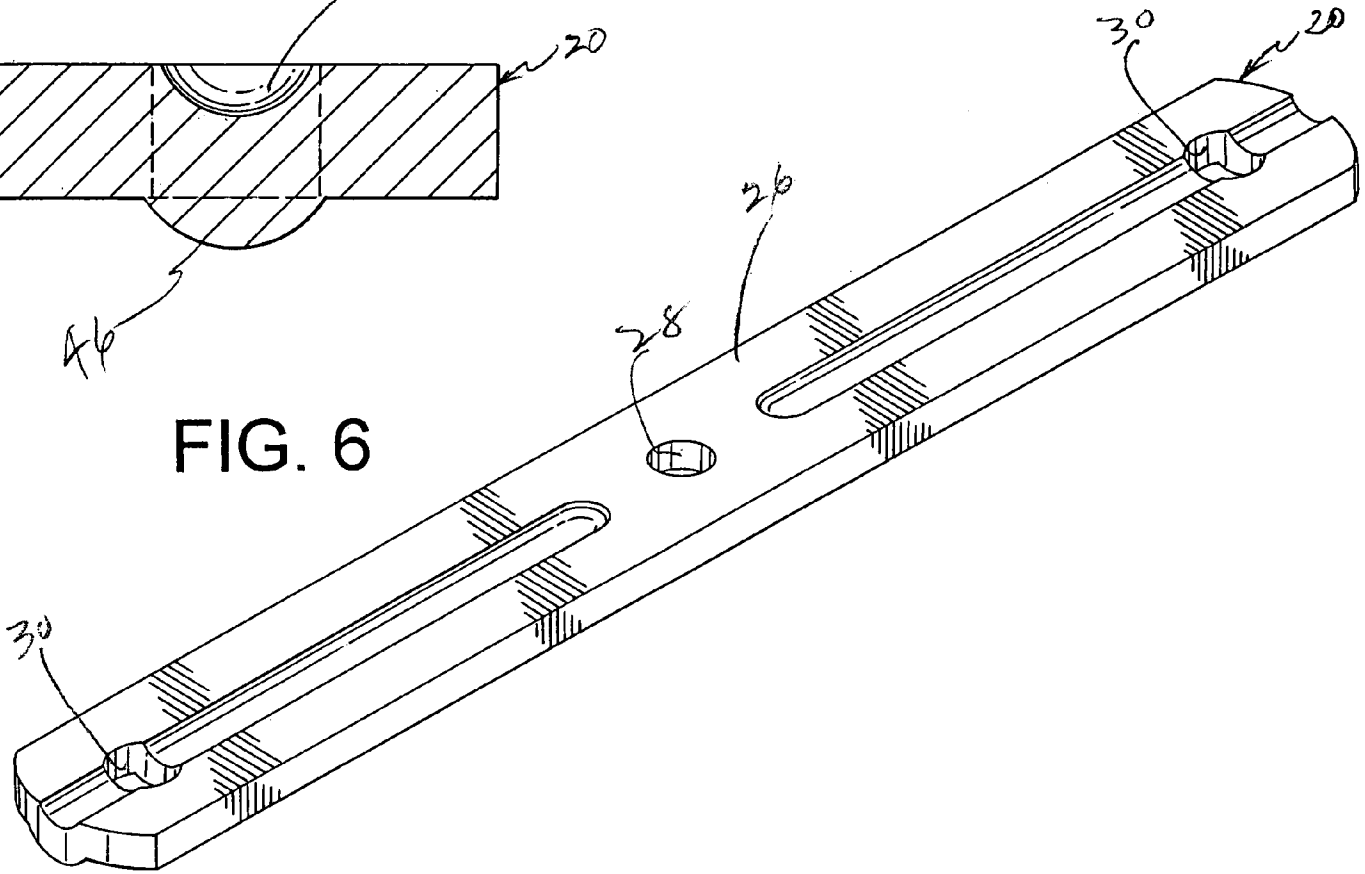
FIG. 5 is an enlarged cross-sectional view taken along line 5—5 of FIG. 4.
FIG. 6 is an enlarged perspective view of the crossbar according to the present invention without the tube-retaining blocks.

As above mentioned, the anvil coacts with a crossbar 20 during the tube-bending operation. The crossbar 20, as seen in FIGS. 4 to 6, includes an elongated bar-shaped member 26 having a central hole 28 mounting the crossbar on the frame of the device and outer end holes or bores 30 for receiving pins 32 that pivotally mount blocks 34 for engaging a tube during the tube-bending operation. For purposes of illustrating the tube-bending function of the device of the invention, a tube 36 is shown in engagement with the anvil 16 and the blocks 34 on the crossbar 20. The tube is shown in bent form as accomplished by the advancing of the anvil toward the crossbar and between the blocks 34. It will be appreciated that at the beginning of a tube-bending operation the anvil is positioned behind the crossbar such that a straight tube can be inserted on the device so that at the area to be bent the tube engages a part of the groove in the anvil and the blocks while the blocks are oriented in somewhat square fashion to the crossbar.

Figure 2:
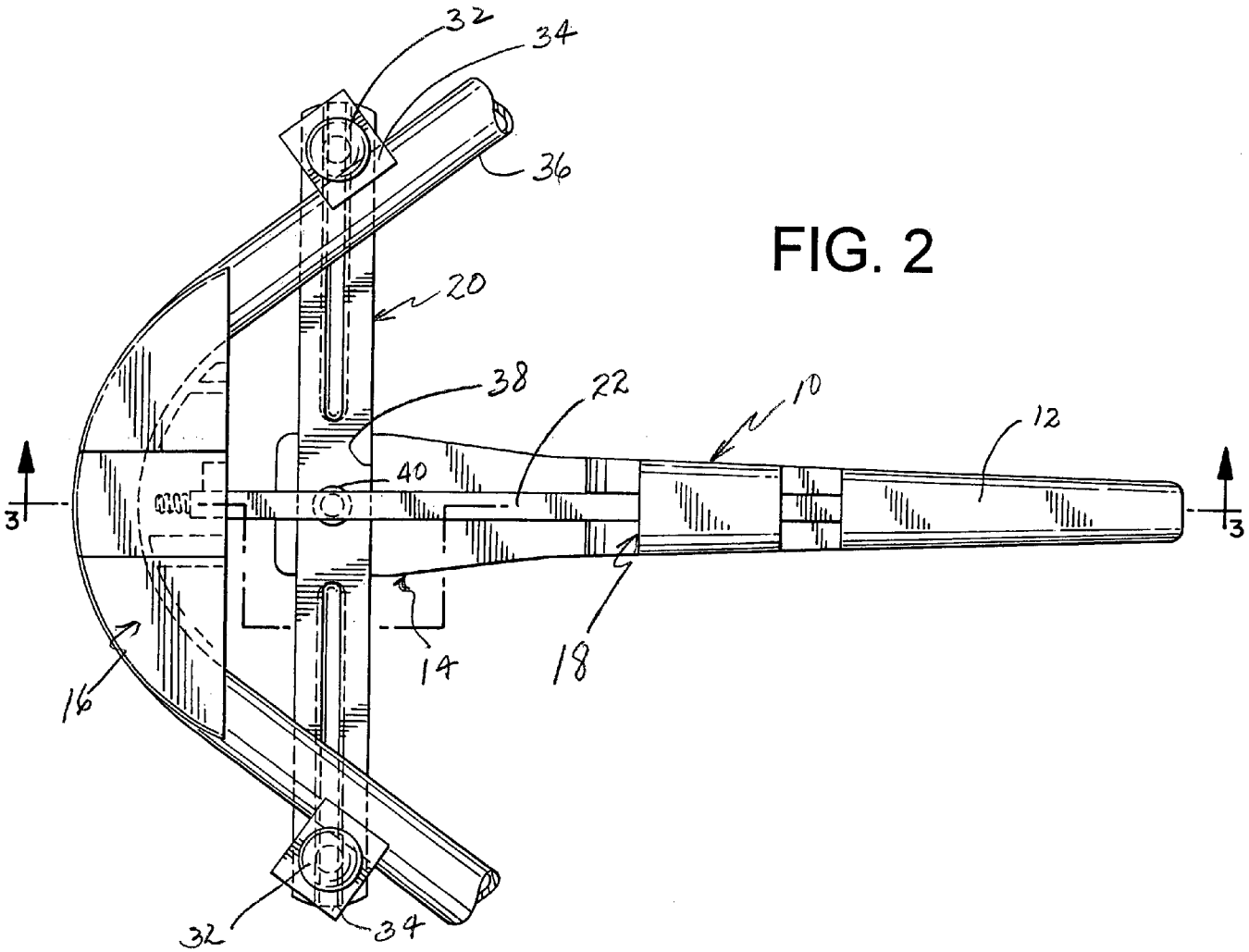
FIG. 2 is a top plan view of the tube-bending device of FIG. 1.

The crossbar 20 extends substantially perpendicular to the frame, as seen particularly in FIG. 2, and is received in a recess 38 formed in the forward end 14 of the frame. A bolt 40 extends through the center hole 28 of the elongated bar member 26 of the crossbar and through an aligned bore formed in the forward end 14 of the frame in a known manner and receives a wing nut 42 to fasten the crossbar in place on the frame of the tube-bending device. Accordingly, the crossbar may be removed easily by removing the wing nut and extracting the crossbar from the recess 38 of the frame so that a crossbar having different sized blocks may be substituted when handling tubes of different sizes. Accordingly, the crossbar is fixed to and stationary with respect to the front end 14 of the frame 10.

Heretofore, failures in the crossbar have been experienced, and accordingly the tube-bending device of the invention includes a crossbar that is reinforced to prevent crossbar failure. The crossbar 20 is reinforced by the displacement of longitudinally extending areas of the crossbar to form dimples or grooves 44 on the upper side and ribs 46 on the lower side. The dimples are formed by displacing the metal of the bar and preferably the dimples extend from a point opposite the central hole 28 to the opposite ends of the bar member 26, as shown particularly in FIGS. 4 and 6. However, it should be appreciated that the dimples may extend only up to the holes 30 for the pins rotatably supporting the blocks 34 if so desired. The crossbar is arranged on the frame of the tube-bending device such that the ribs 46 project downwardly so that the ribs do not interfere with tube placement and tube-bending functions, as particularly shown in FIG. 3.

The ratchet bar 22 of the ratchet mechanism is slidably received in channels 50 and 52 along the frame and particularly adjacent the handle portion 12.

The ratchet mechanism 18 includes an actuating bar 54 pivotally connected to the frame by a pin 56 so that it may be worked toward and away from the handle 12 of the frame 10. A coil spring 58, as seen in FIG. 3, is suitably connected at one end to a pin 60 secured to the frame 10, and at the other end to a lug 62 carried by the actuating bar 54 so as to continually apply a force to the actuating bar that is clockwise to the pin 56.

The actuating bar 54 includes an enlarged pawl receiving section having a bore 64 for slidably receiving the pawl 66 having a tooth 68 for engagement with ratchet teeth 70 on the underside of the ratchet bar 22. The pawl is restrained in slidable movement by including a slotted hole 72 embracing the actuating bar pin 56 so that it can slide between the top and bottom of the slotted hole. A compressing spring 74 is received in a blind bore in the bottom of the pawl and loaded to provide a continuing force of the pawl against the ratchet teeth 70.

A detent 76 is pivotally mounted on a pin 78 and coacts with the ratchet teeth 70 to prevent backsliding of the ratchet bar once it has been advanced toward the crossbar. A leaf spring 78 anchored at one end to the frame by a capscrew 80 has its fee end engaging the underside of the detent 76 to apply a continuing force so that the tooth on the detent engages the ratchet teeth on the ratchet bar. When it is desired to retract the ratchet bar and anvil after a tube-bending operation, the ratchet bar 54 is pivoted away from the handle 12 wherein a lug 82 on the actuating bar engages a lug 84 on the detent 76 and causes a counter-clockwise rotation of the detent, as viewed in FIG. 3, to disengage the detent from the ratchet teeth and allow the ratchet bar to be retracted. Also, the pawl 66 will be moved away from and disengaged from the ratchet teeth so as to not interfere with the retracting movement of the ratchet bar.

In operation, a tube is placed between the anvil and the blocks with the anvil retracted behind the blocks and continued depressing of the actuating bar causes the ratchet mechanism to drive the anvil forward between the blocks on the crossbar to cause a tube-bending operation. The pawl 66 during the squeezing of the actuating bar toward the handle engages the ratchet bar teeth to advance the ratchet bar and the detent 76 prevents the ratchet bar from retracting during the release of the actuating bar 54 that allows the pawl to slide over the ratchet teeth on the return of the actuating bar to the position shown in FIG. 3.

In view of the foregoing, it will be appreciated that the tube-bending device of the present invention produces effective tube-bending operations and avoids failure of the crossbar because it is uniquely reinforced.

It will be understood that modifications and variations may be effected without departing from the scope of the novel concepts of the present invention, but it is understood that this application is to be limited on ly by the scope of the appended claims.

The invention is hereby claimed as follows:

1. A tube-bending device comprising:

a frame, an anvil reciprocally mounted on said frame against which a tube can be positioned for a bending operation, a crossbar mounted on said frame extending perpendicular to the path of said anvil;

tube-engaging means at each end of said crossbar for restraining a tube at each side of said anvil, wherein driving said anvil toward said tube-engaging means causes bending of the tube;

a ratchet mechanism on said frame for driving said anvil substantially linearly in one direction;

means for operating said ratchet mechanism;

the improvement being in said crossbar which further includes reinforcing means for preventing crossbar failure during a bending operation.

2. The tube-bending device of claim 1, wherein said means includes at least one rib formed on said crossbar.

3. The tube-bending device of claim 1, wherein said tube-engaging means includes blocks at each end of the crossbar formed to receive said tube and hold the tube ends opposite the anvil during the tube-bending operation.

4. The tube-bending device of claim 1, wherein said tube-engaging means includes blocks at each end of the crossbar formed to receive said tube and hold the tube ends opposite the anvil during the tube-bending operation, and further wherein said means includes at least one rib formed on said crossbar.

5. The tube-bending device of claim 1, wherein said means includes at least one rib formed on said crossbar, and further wherein said at least one rib projects away from the path of the tube-bending operation.

6. In a portable tube-bending device comprising:

an elongated frame having a handle at one end, a crossbar mounted on the frame at the end opposite the handle, spaced apart tube-engaging blocks on the crossbar against which a tube is held, an anvil slidably mounted on the frame and incrementally movable toward and between said blocks to perform a tube-bending operation, means for driving the anvil, the improvement being in the crossbar, wherein the crossbar includes reinforcing means to prevent crossbar failure.

7. The portable tube-bending device of claim 6, wherein said reinforcing means includes dimples in said crossbar.

8. The portable tube-bending device of claim 6, wherein said reinforcing means includes ribs on the crossbar.

9. The portable tube-bending device of claim 8, wherein the ribs extend along the crossbar from a central area to the opposite ends thereof.

10. The portable tube-bending device of claim 7, wherein said dimples are elongated along the crossbar.

11. The portable tube-bending device of claim 7, wherein said dimples are in the form of elongated displaced portions.

12. The portable tube-bending device of claim 7, wherein said dimples are in the form of elongated recessed areas.

13. The portable tube-bending device of claim 7, wherein said dimples are in the form of elongated depressions on one side of the crossbar, and elongated ribs on the other side of the crossbar.

14. The portable tube-bending device of claim 13, wherein the ribs project away from the blocks.

* * * * *